United States Patent [19]

Wolfe

[11] 4,048,750

[45] Sept. 20, 1977

[54] GAME CALL WITH TWO-DIAPHRAGM SOUNDER

[76] Inventor: Gilbert H. Wolfe, 412 W. 15th St., New Cumberland, Pa. 17070

[21] Appl. No.: 670,629

[22] Filed: Mar. 26, 1976

[51] Int. Cl.[2] ..... G10K 9/20

[52] U.S. Cl. ..... 46/180

[58] Field of Search ..... 46/180, 181, 178, 175 R

[56] References Cited

U.S. PATENT DOCUMENTS

| | | | |
|---|---|---|---|
| 2,083,431 | 6/1937 | Cole | 46/180 X |
| 2,551,367 | 5/1951 | Fahey | 46/180 X |
| 2,580,895 | 7/1951 | Roth | 46/180 |
| 2,678,516 | 5/1954 | Graham | 46/180 X |
| 2,782,558 | 2/1957 | Harley | 46/180 |
| 2,833,086 | 5/1958 | Johenning | 46/180 |
| 2,969,611 | 1/1961 | Warren | 46/180 |
| 3,212,215 | 10/1965 | Freimauer | 46/180 |
| 3,722,133 | 3/1973 | Morgan | 46/178 |
| 3,811,221 | 5/1974 | Wilt | 46/180 |
| 3,900,993 | 8/1975 | Betters | 46/180 |
| 3,968,592 | 7/1976 | Piper | 46/178 |

*Primary Examiner*—F. Barry Shay

*Attorney, Agent, or Firm*—Thomas Hooker

[57] ABSTRACT

A hand-operated game call having a two-diaphragm sound chamber, a collapsible generally tubular bellows extending from one end of the chamber with a weight on the end of the bellows and a hollow handle on the other end of the chamber. The call is held by the handle and moved to collapse the bellows thereby forcing air through the sound chamber to produce a sound simulating the call of a wild turkey. Different turkey calls may be simulated depending upon how the bellows is collapsed.

25 Claims, 5 Drawing Figures

GAME CALL WITH TWO-DIAPHRAGM SOUNDER

The invention relates to game calls for simulating the calls of wild animals and particularly to a game call for simulating calls of the wild turkey. The game call is compact in size and is easily operated by one hand to simulate the gobble, purr, yelp or cluck calls of the wild turkey and in that way attract or calm the birds.

The call includes a two-diaphragm sound chamber, a collapsible generally tubular bellows on one end of the chamber with a weight on the end of the bellows and a hollow handle on the other end of the chamber. Movement of the handle collapses the bellows to force air through the sound chamber thereby producing a sound which is amplified as it passes out the handle. The sound chamber includes a pair of spaced latex diaphragms on opposite ends of the chamber each having a vibrating edge, normally tangent to the edge of an opening at the respective end of the chamber. The diaphragm at the bellows end of the chamber is higher pitched than the diaphragm at the handle end of the chamber. When the bellows is collapsed the passage of air through the chamber vibrates the diaphragms producing sounds simulating calls of the wild turkey. The bellows is made of a self-restoring rubber and is asymetrical to facilitate rapid return to the normal expanded condition after collapse. This improves the call produced.

Bellows-actuated game calls are disclosed in U.S. Pat. Nos. 2,782,558 and 3,900,993. The first patent discloses a hand-held call similar to the call of the present wherein vibrating the handle swings a weight on the end of a bellows to alternately collapse and expand the bellows and force air past a vibratory reed. U.S. Pat. Nos. 2,969,611, 3,722,133 and 3,811,221 disclose game calls having single vibrating diaphragms.

Other objects and features of the invention will become apparent as the description proceeds, especially when taken in conjunction with the accompanying drawings illustrating the invention, of which there is one sheet.

IN THE DRAWINGS

Figure 5:
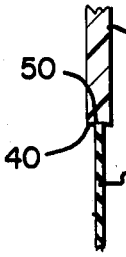
Figure 2:
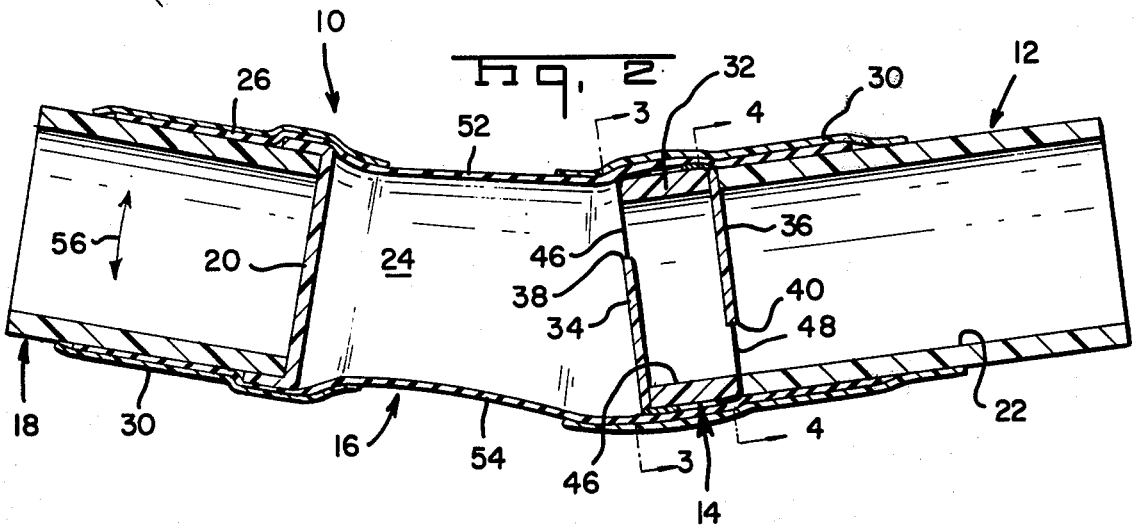
FIG. 2 is a longitudinal sectional view through the game call of FIG. 1.
Figure 3:
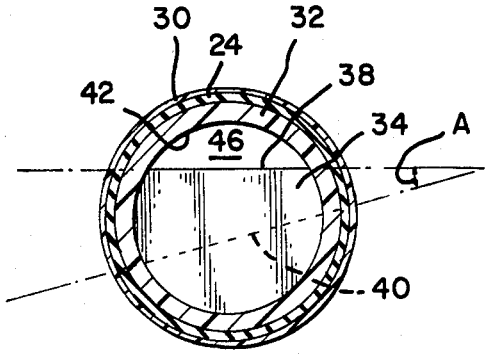
Figure 4:
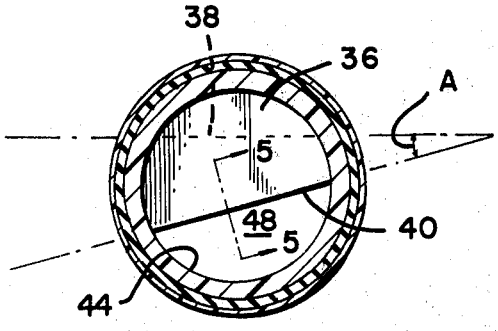

FIGS. 3 and 4 are sectional views taken along lines 3—3 and 4—4 respectively of FIG. 2; and FIG. 5 is a sectional view taken along line 5—5 of FIG. 4.

Figure 1:
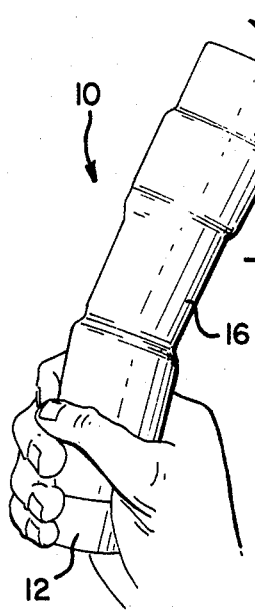
FIG. 1 is a perspective view of a game call in use.

Game call 10 includes handle 12, two-diaphragm sound chamber 14, tubular bellows 16 and weight 18. As illustrated in FIG. 2, the bellows 16 extends between weight 18 and one end of the sound chamber 14. Handle 12 is located on the other end of the sound chamber away from the bellows. In use, the game call 10 is held by handle 12 as shown in FIG. 1 and is shaken to move the weight with respect to the handle to alternately collapse and expand the bellows 16 and force air back and forth through sound chamber 14 thereby generating a sound simulating the call of a wild turkey. The sound is amplified by the cylindrical passage 22 in handle 12.

The bellows 16 is preferably formed from a curved tube 24 of airtight elastic material, preferably rubber. End 26 of the tube 24 is fitted over cap 20 and the exterior surface of cylindrical weight 18 and end 28 of the tube is fitted over the exterior surfaces of the sound chamber 14 and handle 12. The ends of the tube are secured to the weight, sound chamber and handle by suitable wrappings 30 to form airtight seals assuring that collapse and expansion of the bellows forces air back and forth through the sound chamber 14.

Chamber 14 includes a cylindrical body 32 having rigid walls 34 and 36 partially closing the ends of the body facing, respectively, the bellows 16 and handle 12. A portion of end wall 34 is cut away at chord 38 and a portion of end wall 36 is cut away at chord 40 to define openings 42 and 44 in the interior 46 of the sound chamber. Opening 42 is at the end of the chamber adjacent the bellows and is defined by chord 38 and its subtended arc on the interior surface of the body 32. The opening 44 is at the end of the sound chamber adjacent handle 12 and is defined by chord 40 and its similar subtended arc. As indicated in FIGS. 3 and 4, chord 40 is longer than chord 38 so that opening 44 is larger than opening 42.

A thin latex high frequency diaphragm 46 is stretched across opening 42 and includes a straight edge normally held against chord 38 of wall 34. The diaphragm is suitably secured to the bellows-end of body 12. A similar low frequency diaphragm 48 closes opening 44 and, as illustrated in FIG. 5, includes a straight edge 50, normally held against chord 40 of wall 36. The diaphragms may be tangent to the chords. Both diaphragms are distorted and vibrate when air passes into and out of chamber 14 through openings at the chords 38 and 40. Diaphragm 46 is preferably tauter than diaphragm 48.

As illustrated in FIGS. 3 and 4, openings 42 and 44 are on opposite sides of chamber 14. As viewed along the axis of the sound chamber, chords 38 and 40, when extended, intersect at an angle A (see FIGS. 3 and 4) of about 15°. The interior of the sound chamber may have a diameter of 1¼ inch and a length of ⅞ inch with chord 38 having a length of 1 inch and chord 40 having a length of 1 1/10 inch.

Preferably, handle 12, sound chamber body 32 and weight 18 are formed from lengths of cylindrical hard plastic material, such as commercially available plastic pipe. The tube 24 is preferably curved so that the length of the bellows between cap 20 and sound chamber 14 at side 52 is less than the length of the opposite side 54 of the bellows and the axis of weight 18 and the handle and sound chamber intersect at a shallow angle.

Game call 10 is particularly useful in simulating a number of calls of the wild turkey. In use, handle 12 is grasped as shown in FIG. 1 and the call 10 is shaken back and forth so that the weight 18 is moved back and forth as indicated by arrow 56 alternately collapsing and expanding bellows 16. Each collapse and expansion of the bellows forces air into and out of the sound chamber by flexing the diaphragms away from the cords of end walls 34 and 36. The inward and outward movement of the air vibrates the diaphragms producing sounds accurately simulating the call of a wild turkey. It is believed that the sounds produced by the flow of air into and out of the sound chamber reverberate between walls 34 and 36 thereby enhancing the resultant sound which is amplified as it passes from the sound chamber and out the cylindrical opening or horn 22 of handle 12. Location of the high frequency diaphragm immediately adjacent the bellows also enhances the sound produced by the call 10. This sound is found to most closely imitate the actual call of a wild turkey when, as illustrated in FIGS. 3 and 4, the cords 34 and 40 are positioned on opposite sides of the sound chamber and are angled with respect to each other at an angle of about 15 degrees.

Call 10 may be used in a number of ways to produce sounds accurately imitating various sounds or calls of the wild turkey. For instance, a gobble call may be produced by holding game call 10 at knee level and shaking by the wrist back and forth vigorously three or four times. The gobble call is used by a male turkey in the spring mating season to challenge other males and when produced by the game call attracts male turkeys. This call is most useful in attracting turkeys.

A turkey purr or drum call is produced by quickly vibrating the wrist with a nervous or quivering motion. Turkeys purr when feeding and are attracted by this call.

A turkey yelp is produced by holding the game call 10 upright with the weight curved towards the operator and then snapping the call away from the operator to produce each yelp. The weight should be thrown down with sufficient force to hit the hand of the operator when producing this call. The curvature in the bellows causes the weight to snap back abruptly, thereby improving the sharp yelp call. Turkeys yelp when lost and in this way attract members of the flock.

The cluck call is produced by holding the handle and pressing the weight directly toward the handle to collapse the bellows. This call is used in the spring as a mating call and also is the sound made by a contended flock. This call tends to reassure turkeys.

Game call 10 simulates the gobble, purr, putt, yelp and cluck calls of the wild turkey with great accuracy and is particularly useful to hunters and photographers desiring to lure and reassure turkeys. The call is easily held and operated by one hand and can be folded up and stored in a small pocket. Because of its relatively small size, operation does not require large movements which might scare away turkeys.

While I have illustrated and described preferred embodiments of my invention, it is understood that this is capable of modification, and I therefore do not wish to be limited to the precise details set forth, but desire to avail myself of such changes and alterations as fall within the purview of the following claims.

What I claim as my invention is:

1. A game call including a sound chamber, a handle joining the sound chamber and having a horn in communication with the sound chamber, a bellows, means joining the bellows and the sound chamber to force air through the sound chamber upon collapse and extension of the bellows, a weight secured to the bellows away from the sound chamber to facilitate collapse of the bellows upon movement of the handle, the sound chamber including an interior volume, a first wall with an opening therein communicating with the bellows and a second wall spaced from said first wall and having an opening therein communicating with the horn, a first flexible diaphragm normally closing said first opening and a second flexible diaphragm normally closing said second opening, each diaphragm including a taut edge flexible to permit movement of air into and out of the sound chamber upon movement of the bellows.

2. A game call as in claim 1 wherein said openings are on opposed ends of the sound chamber.

3. A game call as in claim 2 wherein the diaphragm adjacent the bellows produces a higher pitched sound than the diaphragm adjacent the horn.

4. A game call as in claim 2 wherein the bellows is generally tubular and extends between the sound chamber and weight, the distance between the sound chamber and weight on one side of the bellows being greater than the distance between the sound chamber and weight on the opposite side of the bellows.

5. A game call as in claim 1 wherein the sound chamber includes an interior volume having said first and second walls as parallel opposed end walls thereof, each said opening includes a straight edge, each diahragm including a straight edge normally resting against an opening edge.

6. A game call as in claim 5 wherein the edge of the opening adjacent the bellows is shorter than the edge adjacent the handle.

7. A game call as in claim 6 wherein the openings are located on opposite sides of the sound chamber.

8. A game call as in claim 7 wherein said opening straight edges do not parallel each other.

9. A game call as in claim 8 wherein said opening straight edges diverge from each other at an angle of about 15° when projected on a plane parallel to an end wall.

10. A game call as in claim 1 wherein the sound chamber includes a body having a generally cylindrical interior volume with said first and second walls as parallel end walls thereof, chordal openings in the end walls, flexible diaphragms normally closing said openings with vibratory edges normally engaging the chords of the cpenings, the opening adjacent the bellows being smaller than the opening adjacent the horn, and the openings being located on opposite sides of the sound chamber.

11. A call including a sound chamber having means for the passage of air and an air source attached to the chamber, said passage means including a first wall portion having an opening communicating the chamber with the source and a second wall portion spaced from the first wall portion and having an opening therein, a flexible vibratory diaphragm stretched across said first walls opening and having a free edge normally resting on an edge of the first wall opening to close the opening, a second vibratory diaphragm stretched across the second wall opening and including a free edge resting on an edge of such second wall opening to normally close such opening, said air source including means for forcing air through the chamber via said passage means and past both diaphragms, whereby air moved by the source through the sound chamber and past the diaphragms vibrates both diaphragms at said edges to produce a reverberant two-toned call.

12. A call as in claim 11 wherein said openings are on opposite ends of the sound chamber.

13. A call as in claim 12 wherein each of said openings includes a straight edge, the edge of the respective diaphragm closing the opening at such opening edge.

14. A call as in claim 13 wherein said sound chamber includes a body of uniform transverse cross section, parallel ends, and wherein said straight edges comprise chords extending between the sides of the body.

15. A call as in claim 14 wherein said chords are not parallel.

16. A call as in claim 15 wherein said chords, when viewed along the axis of the body, intersect at an angle of about 15°.

17. A call as in claim 16 wherein the interior surface of the body is cylindrical.

18. A call as in claim 17 wherein the diameter of the sound chamber is about $1\frac{1}{4}$ inch, the length of the sound chamber between ends is about $\frac{7}{8}$ inch, the length of the chord adjacent the source is about 1 inch and the length of the chord away from the source is about 1 1/10 inch.

19. A call as in claim 18 wherein said diaphragm edges are normally tangent said chords.

20. A call as in claim 13 wherein the frequency of sound generated by the diaphragm adjacent the source is higher pitched than the frequency of the sound generated by the diaphragm away from the source.

21. A call as in claim 18 wherein the chord adjacent the source is shorter than the chord away from source.

22. A call as in claim 13 wherein said source comprises a bellows asymetrical on opposite sides.

23. A game call comprising a handle including a horn, a sound generating member at one end of the handle including a two-diaphragm sound chamber with a first flexible diaphragm normally closing an aperture in a wall portion located between the bellows and the chamber and a second flexible diaphragm normally closing an aperture in a wall portion located between the chamber and the horn, a bellows secured to the sound generating member and extending away from the handle, and a weight at the end of the bellows away from the handle, said bellows comprising a generally tubular-shaped length of resilient self-restoring material tightly joined to the sound generating member and to the weight so that movement of the weight with respect to the sound generating member forces air through the member, said bellows being asymetrical on opposite sides thereof to facilitate rapid return to an expanded condition following a collapse.

24. A game call as in claim 23 wherein the distance between the member and weight on one side of the bellows is greater than the distance between the member and weight on the other side of the bellows.

25. A game call as in claim 24 wherein the bellows is formed from a length of curved tubing.

* * * * *